US010246928B2

(12) United States Patent
Fletcher et al.

(10) Patent No.: US 10,246,928 B2
(45) Date of Patent: Apr. 2, 2019

(54) ARMORED WINDOW DRIVE MECHANISM AND SYSTEM

(71) Applicant: Milton Manufacturing Inc., Detroit, MI (US)

(72) Inventors: William K. Fletcher, Richmond, MI (US); Mariusz Surowiec, Sterling Heights, MI (US); Robin Lee Hull, Waterford, MI (US); Roberto Cervera, Madison Heights, MI (US)

(73) Assignee: MILTON MANUFACTURING INC., Detroit, MI (US)

( * ) Notice: Subject to any disclaimer, the term of this patent is extended or adjusted under 35 U.S.C. 154(b) by 0 days.

(21) Appl. No.: 15/712,821

(22) Filed: Sep. 22, 2017

(65) Prior Publication Data

US 2018/0087309 A1 Mar. 29, 2018

Related U.S. Application Data

(60) Provisional application No. 62/398,853, filed on Sep. 23, 2016.

(51) Int. Cl.

| | |
|---|---|
| ***E05F 15/689*** | (2015.01) |
| ***F41H 5/26*** | (2006.01) |
| ***E05D 15/22*** | (2006.01) |

(52) U.S. Cl.

CPC ..... *E05F 15/689* (2015.01); *E05D 15/22* (2013.01); *F41H 5/263* (2013.01); *E05Y 2800/122* (2013.01); *E05Y 2900/504* (2013.01); *E05Y 2900/55* (2013.01)

(58) Field of Classification Search

CPC ..... E05F 15/689; E05D 15/22; F41H 5/263; E05Y 2800/122; E05Y 2900/504; E05Y 2900/55

USPC ..... 49/348, 349, 414, 415, 416

See application file for complete search history.

(56) References Cited

U.S. PATENT DOCUMENTS

| | | | | | |
|---|---|---|---|---|---|
| 42,431 | A * | 4/1864 | Center | E06B 3/44 | 49/414 |
| 1,517,913 | A * | 12/1924 | Lenahan | E05F 11/382 | 49/348 |
| 1,627,331 | A * | 5/1927 | Hirst | E05F 11/405 | 49/348 |
| 1,880,173 | A * | 9/1932 | Carter | E06B 3/44 | 49/416 |
| 1,934,816 | A * | 11/1933 | Randall | B60J 10/74 | 49/416 |
| 1,997,822 | A * | 4/1935 | Hamm | B61D 25/00 | 49/416 |

(Continued)

FOREIGN PATENT DOCUMENTS

| | | | | |
|---|---|---|---|---|
| DE | 4207924 A1 * | 9/1993 | ..... | B60J 1/17 |
| DE | 202011001371 U1 * | 4/2011 | ..... | B32B 17/10045 |

*Primary Examiner* — Jerry E Redman

(74) *Attorney, Agent, or Firm* — Vivacqua Law

(57) ABSTRACT

An armored window drive mechanism includes a window unit containing a bullet resistant glass, composite or polymeric material window positioned within a window frame of a vehicle. A motorized window mechanism is connected to a door structure of the vehicle and acts to raise or lower the window unit. A mechanism connector is adapted to convert an axial rotational force generated by the window mechanism to a lifting and a lowering force acting directly at a lower face of the window frame.

15 Claims, 10 Drawing Sheets

(56) References Cited

U.S. PATENT DOCUMENTS 2,124,037 A * 7/1938 Lavigne ..... E05F 11/382 180/286
2,150,829 A * 3/1939 Grishkevich ..... E05F 11/382 160/90
2,326,532 A * 8/1943 Graebner ..... B60J 1/17 49/375
2,714,004 A * 7/1955 Wise ..... E05F 11/405 49/349
2,731,261 A * 1/1956 Drum ..... E05F 11/405 49/26
2,781,876 A * 2/1957 Van Fleet ..... E06B 3/44 292/76
2,796,960 A * 6/1957 Reynolds ..... E06B 3/44 49/416
2,872,184 A * 2/1959 Wise ..... E05F 11/405 49/227
2,922,639 A * 1/1960 Martens ..... E05F 11/405 49/227
2,945,691 A * 7/1960 Swift ..... E05F 11/405 464/88
2,947,535 A * 8/1960 Crosby ..... E05F 11/405 49/349
2,955,816 A * 10/1960 Wise ..... E05F 11/405 464/88
3,062,528 A * 11/1962 Martens ..... E05F 11/405 49/227
3,143,340 A * 8/1964 Maslonka ..... E05F 11/405 49/351
3,145,433 A * 8/1964 Jones ..... E06B 3/26347 49/414
3,183,559 A * 5/1965 Love ..... E05F 11/00 16/197
3,209,412 A * 10/1965 Golde ..... B60J 1/17 16/200
3,219,335 A * 11/1965 Burridge ..... E05F 11/382 49/360
3,691,684 A * 9/1972 Boneck ..... E05F 15/665 49/21
4,575,967 A * 3/1986 Bickerstaff ..... B60J 1/17 49/211
5,012,613 A * 5/1991 Sekine ..... B60J 1/17 49/349
5,309,677 A * 5/1994 Kunert ..... E05F 11/405 49/349
6,280,826 B1 * 8/2001 Woll ..... B32B 17/10045 109/49.5
6,305,125 B1 * 10/2001 Nozaki ..... B60J 1/17 49/415
6,430,878 B2 * 8/2002 Terasawa ..... B60R 13/07 49/414
6,630,235 B2 * 10/2003 Oshima ..... B32B 17/10064 428/332
7,114,760 B2 * 10/2006 Cameron ..... B60J 1/20 296/152
7,861,462 B2 * 1/2011 Smith ..... E05F 11/385 49/348
8,042,303 B2 * 10/2011 Gandhi ..... B60J 10/244 49/414
2002/0017802 A1 * 2/2002 Edwards ..... B60R 25/016 296/136.01
2002/0092239 A1 * 7/2002 Fin ..... E05F 11/405 49/349
2004/0003544 A1 * 1/2004 Berry ..... B60J 1/17 49/374
2004/0045221 A1 * 3/2004 Oberheide ..... E05F 11/405 49/349
2004/0187391 A1 * 9/2004 Fenelon ..... E05F 11/385 49/375
2004/0226223 A1 * 11/2004 Lubaway ..... E05F 1/1091 49/349
2007/0261311 A1 * 11/2007 Renke ..... E05F 15/60 49/349
2013/0171398 A1 * 7/2013 Stranner ..... B32B 17/10045 428/38
2018/0156578 A1 * 6/2018 Trudeau ..... F41H 7/04

* cited by examiner

ARMORED WINDOW DRIVE MECHANISM AND SYSTEM

CROSS REFERENCE TO RELATED APPLICATIONS

This application claims the benefit of U.S. Provisional Patent Application No. 62/398,853, filed on Sep. 23, 2016, the entire contents of which are incorporated herein by reference.

INTRODUCTION

The present disclosure relates to a system and mechanism used to raise and lower a bullet-resistant glass or composite window.

BACKGROUND

Known armored vehicles, such as military vehicles, armored currency carriers, and armored cars or limousines commonly provide one or more "armored" or bullet-resistant glass or composite windows. Known bullet-resistant glass or composite windows weigh up to approximately 250 pounds. There are no known mechanisms developed to fully raise and lower windows of such weight, therefore known bullet resistant glass or composite windows are generally fixed in position in their door frames, or are movable only to a limited degree. This limits the accessibility of the vehicle driver or passenger for example when stopped for security check points, toll booths, and the like, and may undesirably require the vehicle driver or passenger to open the vehicle door during such times.

In addition, it is desirable to allow for back-fit of a window lift system into existing armored vehicles that do not have the capability of displacing existing bullet-resistant windows. The window structure of such vehicles may not currently permit sufficient flexibility to allow up and down window motion due to internal structure, and a back-fit window system that provides for multiple plane movement of the window is not presently known.

Thus, while current armored or bullet-resistant glass or composite window lift or control systems achieve their intended purpose, there is a need for a new and improved system and method for raising and lowering bullet-resistant glass or composite windows.

SUMMARY

According to several aspects, an armored window drive mechanism includes a window unit containing a bullet resistant glass, composite or polymeric material window positioned within a window frame. A motorized window mechanism is fixed to a door structure of a vehicle and acts to raise or lower the window unit. A mechanism connector is adapted to convert an axial rotational force generated by the window mechanism to a lifting and a lowering force acting directly at a lower face of the window frame.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
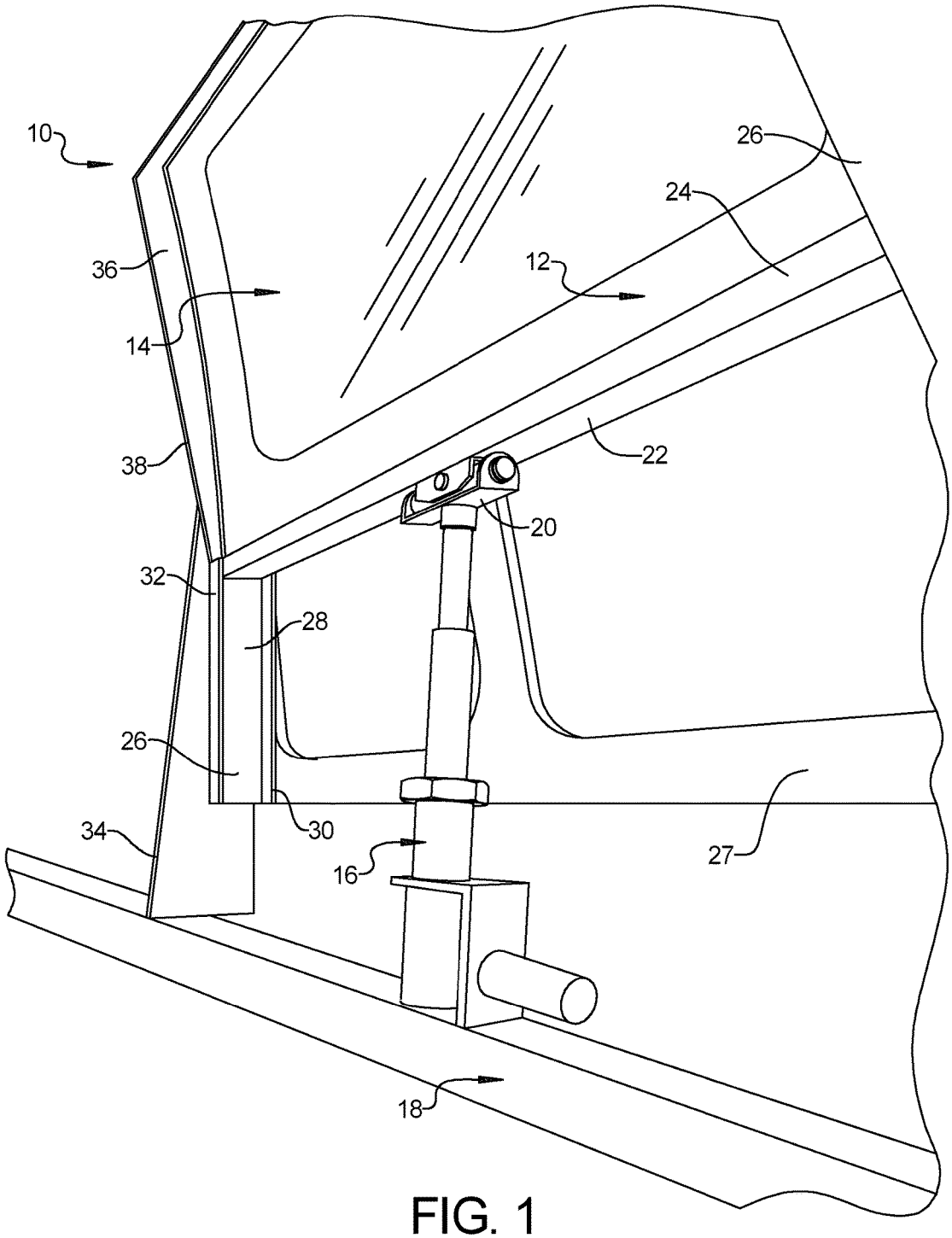
FIG. 1 is a side elevational right perspective view of a vehicle door structure having an armored window drive mechanism and system of the present disclosure.

Referring to FIG. 1, an armored window drive mechanism and system, hereinafter window system 10, includes a window unit 12 containing a bullet resistant glass, composite or polymeric material window 14. The window unit 12 is raised or lowered using a motorized window mechanism 16 which is connected to an existing door structure 18 of a vehicle. A mechanism connector 20, used in two locations on the window mechanism 16, operates similar to a gimbal system or a universal joint and is adapted to transfer the axial rotational force generated by the window mechanism 16 to generate a lifting or lowering force directly to a lower face 22 of a window frame 24 which supports the window unit 12. The mechanism connector 20 is required to be able to positively retract (lower) or raise the window unit 12 because the window system 10 is intended to operate even if the vehicle rolls over to a non-upright position.

The window frame 24 is slidably received and guided within opposed side rails or track channels 26, only one of which is completely visible in this view. The track channels 26 each have a pad 28 of a low frictional coefficient material such as a polyamide contained between opposed flanges 30, 32. The window frame 24 including the flanges 30, 32 is commonly fixed to a receiving structure 27 which is installed as a unit onto the door structure 18, for example after an originally installed window unit 12 is removed, or as a new unit in a new construction vehicle.

The track channels 26 including the flanges 30, 32 can be adapted to suit the individual existing door structure 18. For example a lower section 34 of the existing door structure 18 may be oriented at a different angle than an upper section 36, such that an angular convergence 38 may be provided between the lower and the upper sections 34, 36. The widow frame 24, including the track channels 26 and the flanges 30, 32 is therefore intended to be either back-fit within an existing frame structure of an existing vehicle door structure 18, or can be installed as a new-construction component.

Figure 2:
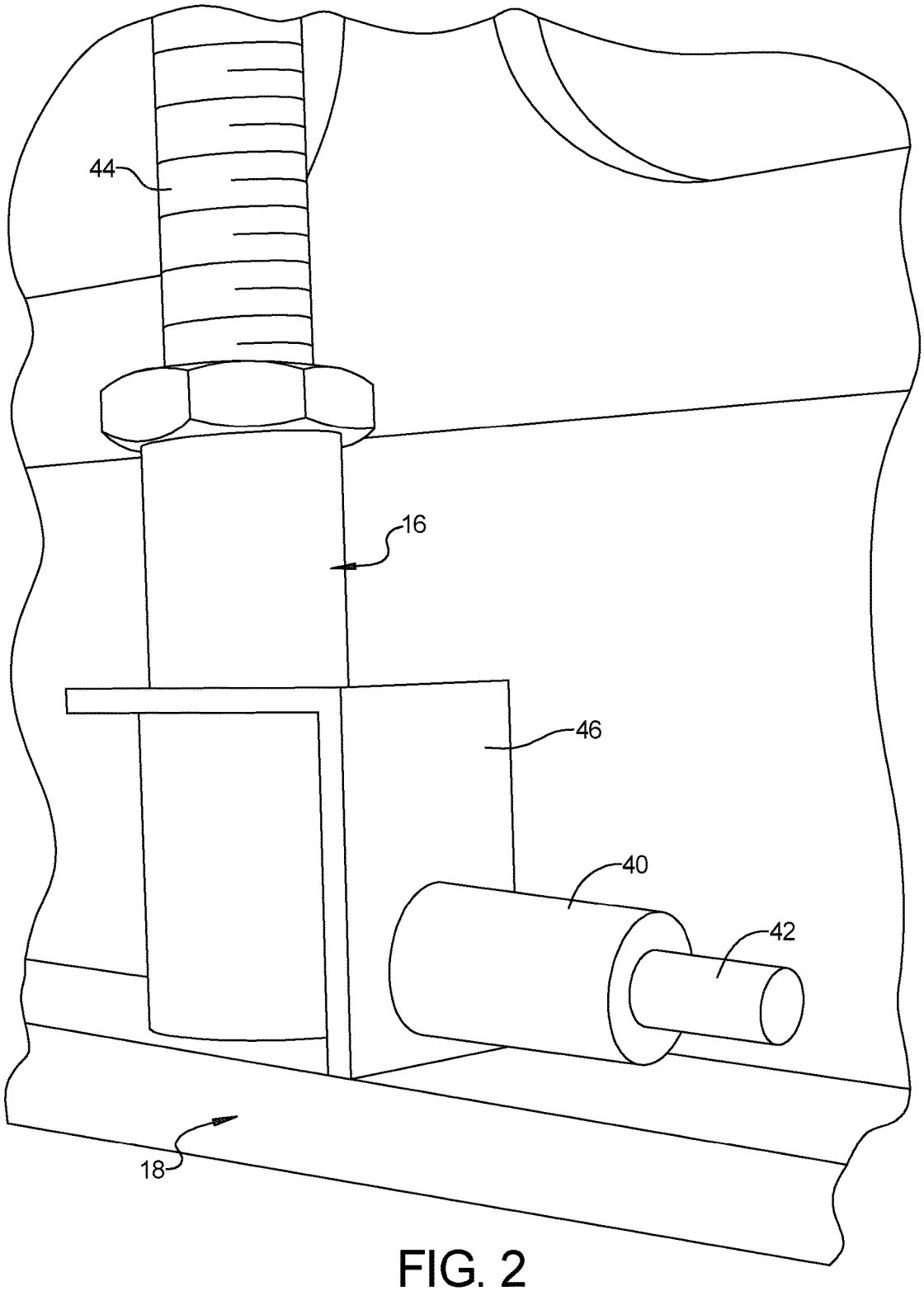
FIG. 2 is a side elevational right perspective view of an input drive unit of the armored window drive mechanism and system of FIG. 1.

Referring to FIG. 2, the window mechanism 16 includes an input drive unit 40 having an axially rotatable input drive shaft 42 connected to and rotated by an electric motor (not shown). A backup battery (not shown) is also provided proximate to the window mechanism 16 to provide backup motor power in the event the vehicle electrical system fails, such that the window unit 12 can be raised/lowered a minimum number of times (for example: 2 cycles of operation) using battery power. The input drive unit 40 is connected to and axially displaces a telescoping unit 44. The window mechanism 16 is retained in the existing door structure 18 by a frame 46 fixed to the door structure 18.

Figure 3:
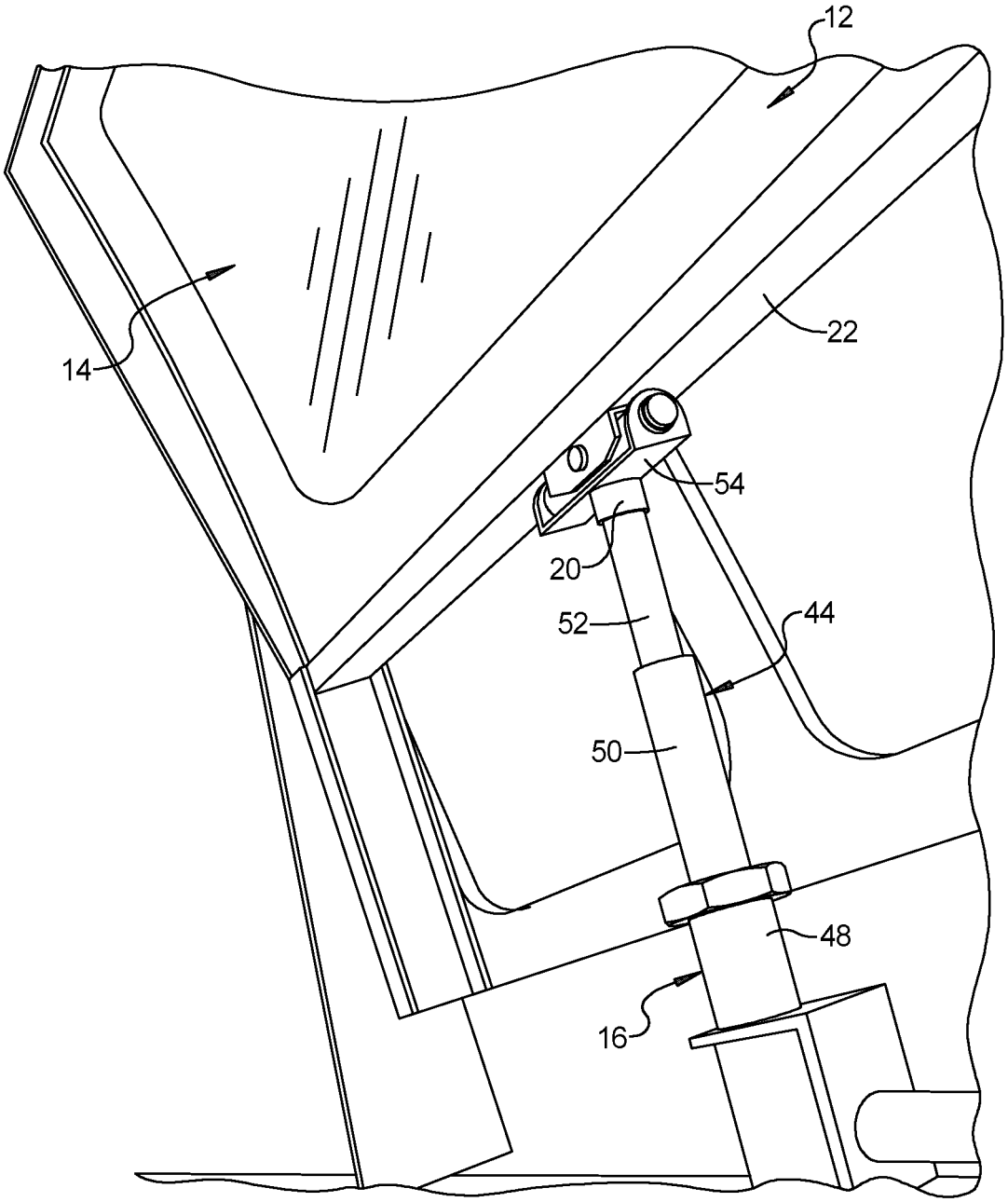
FIG. 3 is a side elevational right perspective view of a lift screw portion of the input drive unit of FIG. 2.

Referring to FIG. 3, the telescoping unit 44 of the window mechanism 16 further includes a lower unit 48, a first telescoping section 50, and a second telescoping section 52. The first telescoping section 50 and the second telescoping section 52 can for example be threaded rods. The mechanism connector 20 is attached to a free end of the second telescoping section 52 and rotatably connects to a receiving member 54 connected to the lower face 22 of the window frame 24.

Figure 4:
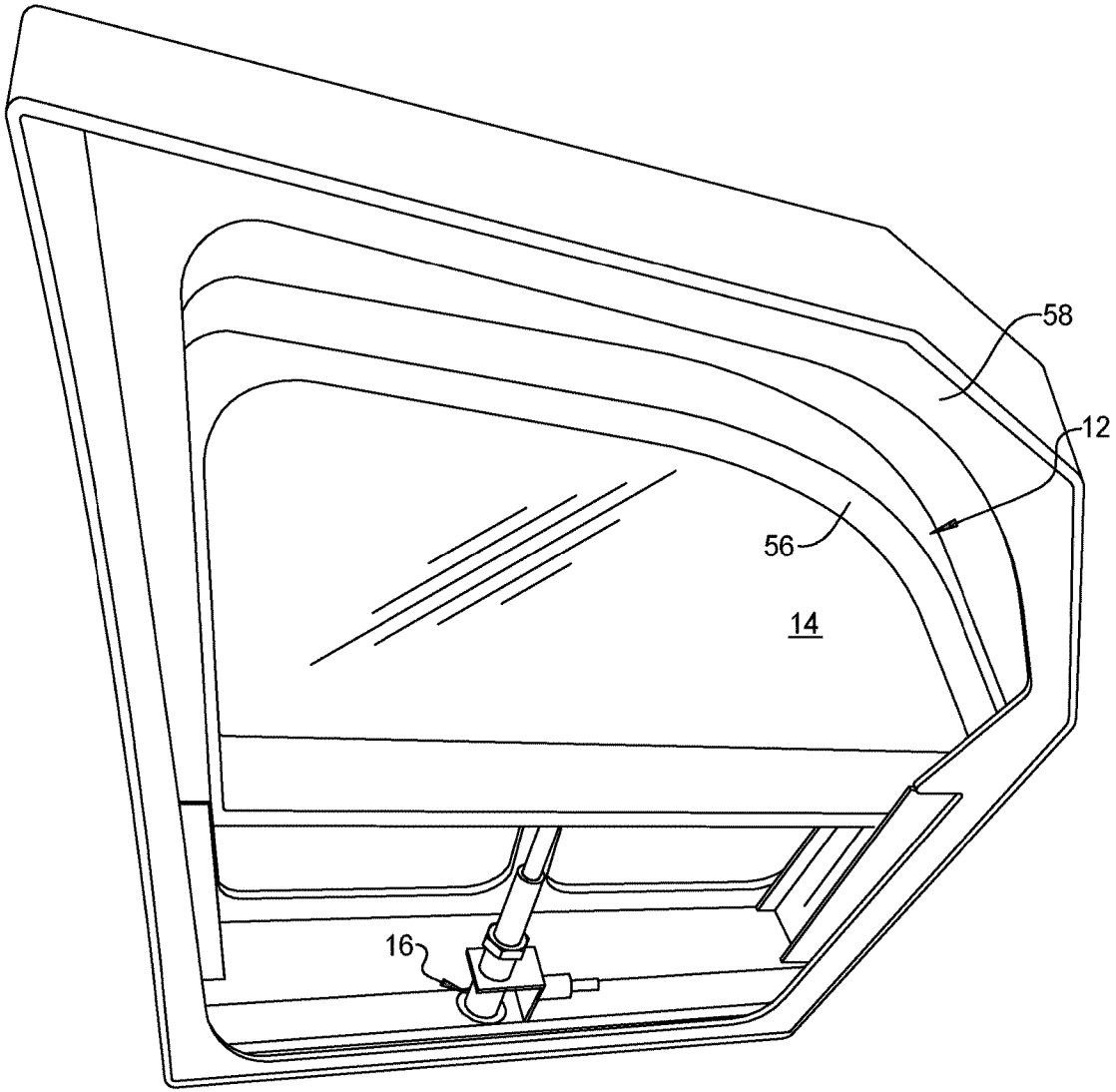
FIG. 4 is a top perspective view of the armored window drive mechanism and system of FIG. 1.

Referring to FIG. 4, the window system 10 is capable of displacing the window unit 12 from a closed position (not shown) having an upper window frame member 56 contacting a door structure 58, to an open position (partially shown). Even if the existing door structure 18 geometry does not permit the window unit 12 to fully open (be completely displaced within structure of the door to a full height of the window unit 12), in the "open" position the window system 10 is capable of displacing the window unit 12 downward by at least 75% of a height of the window unit 12 or more, within a space available in the existing door structure 18 also incorporating the window mechanism 16.

Figure 5:
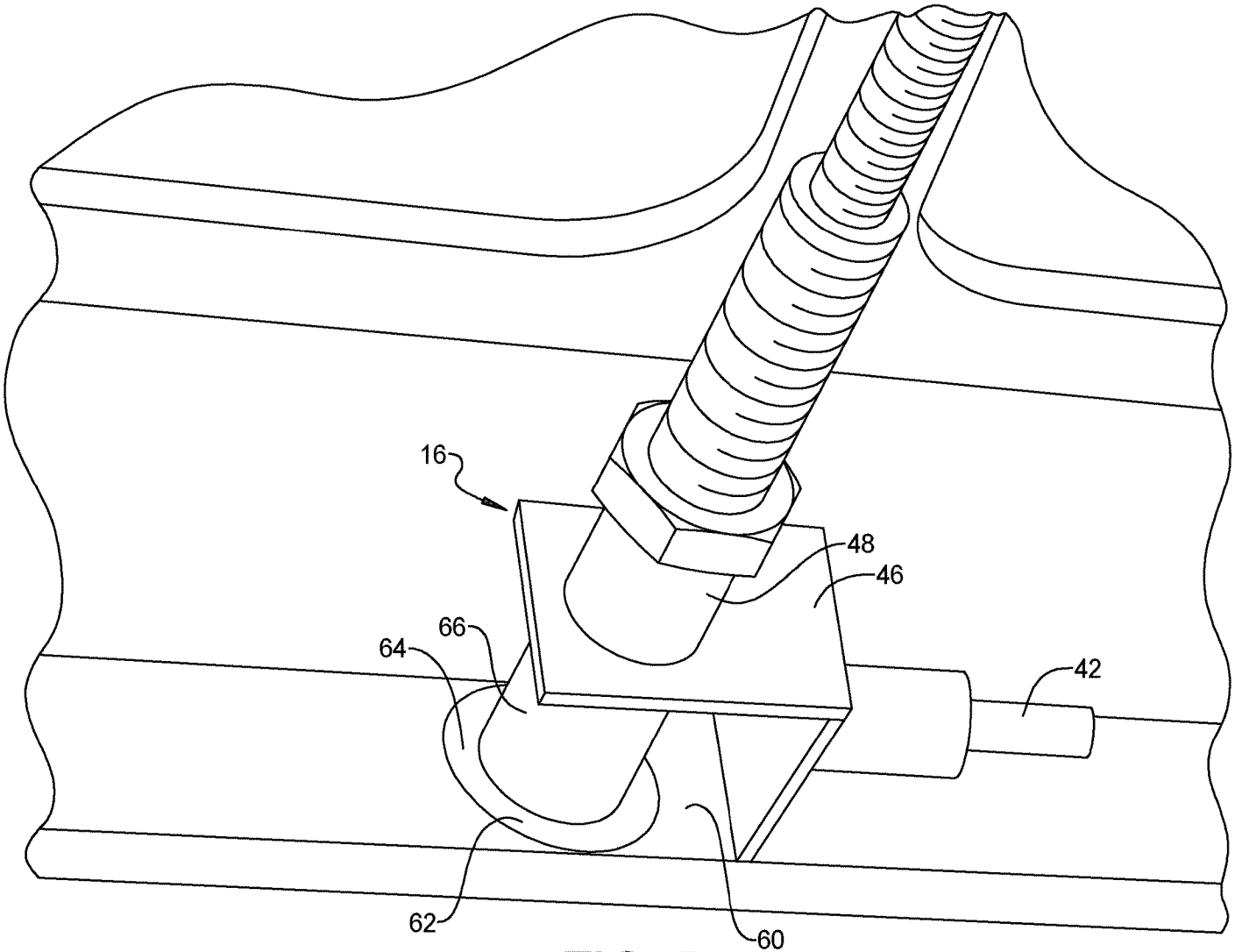
FIG. 5 is a top perspective view of the lift screw portion of the input drive unit of FIG. 2.

Referring to FIG. 5, the window mechanism 16 further includes an input drive member 60 having an angle gear 62 which meshes with a second angle gear 64 connected to a drive member portion 66 of the lower unit 48. In this way, a space envelope required for the window mechanism 16 and the motor are minimized.

Figure 6:
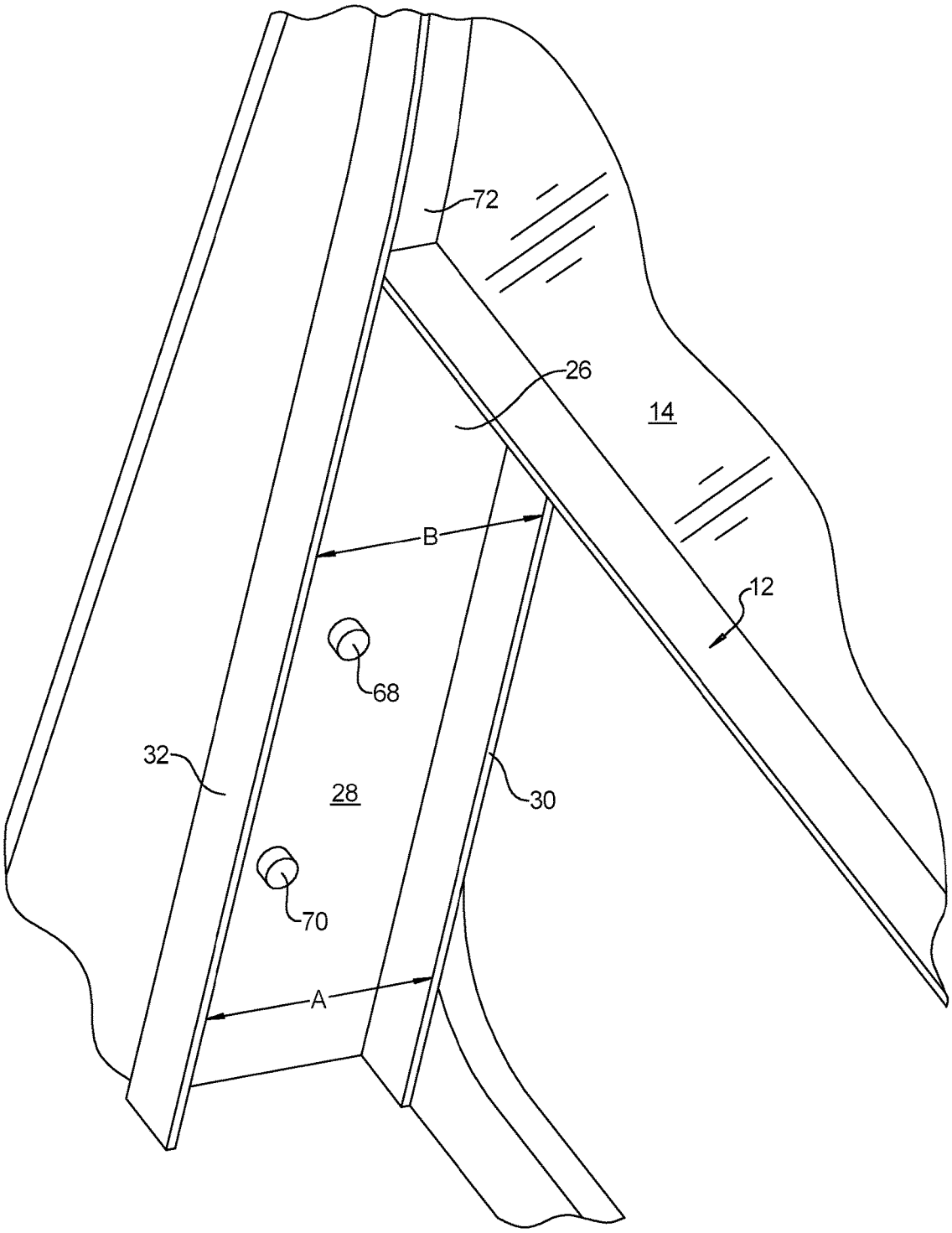
FIG. 6 is a side elevational right perspective view of a window frame of the armored window drive mechanism and system of FIG. 1.

Referring to FIG. 6, the track channels 26 including the flanges 30, 32 can have a width "A" proximate to a bottom of the track channels 26 that is greater than a width "B" proximate to a top of the track channels 26, thereby allowing the window unit 12 to displace not only up and down, but also toward and away from an inside space of the vehicle as the window unit displaces. This allows window unit motion even when the lower section 34 of the existing door structure 18 (shown and described in reference to FIG. 1) may be oriented at a different angle than the upper section 36 as previously described. In addition, the pad 28 of low frictional coefficient material positioned in each of the track channels 26 can displace toward and away from the viewer as viewed in FIG. 6. This motion is assisted by the biasing force of multiple spring biasing devices such as spring biasing devices 68, 70. The pad 28 is therefore biased into constant contact with perimeter frame members 72 of the window unit 12, thereby slidably guiding an up and down or vertical motion of the window unit 12.

Figure 7:
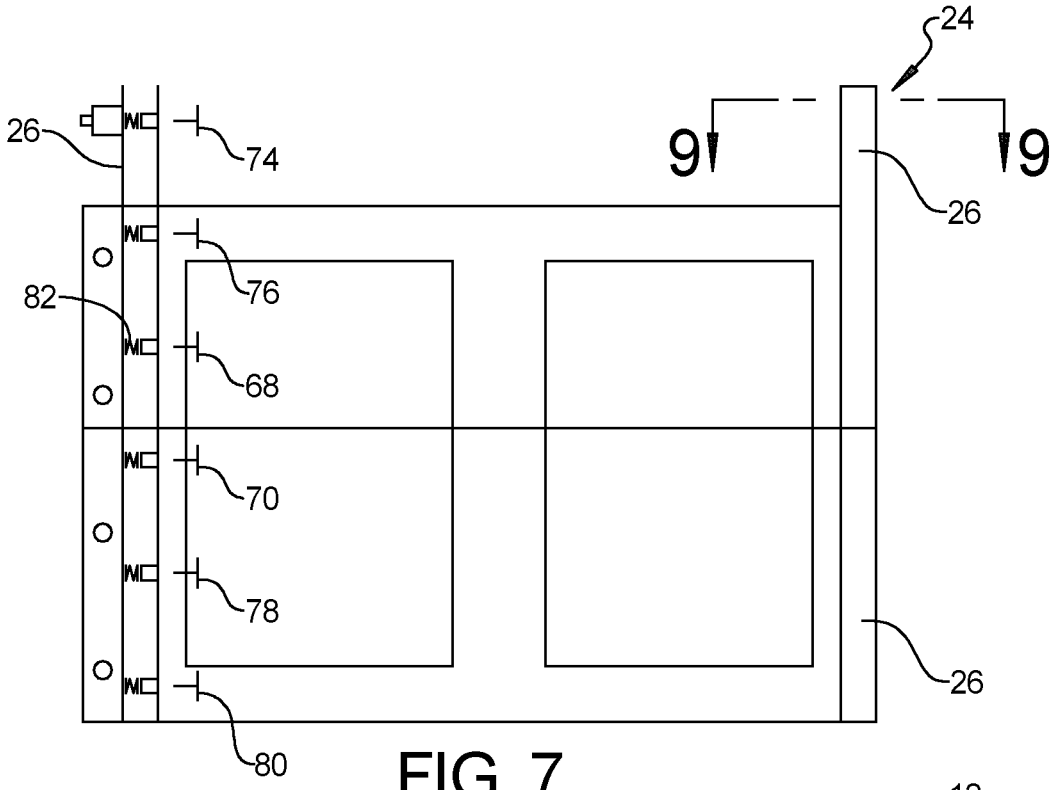
FIG. 7 is a side elevational view of a window frame adapted for displacement by the armored window drive mechanism of FIG. 1.

Referring to FIG. 7, in addition to the spring biasing devices 68, 70 discussed above, multiple spring biasing devices can be provided with each of the pads 28, including spring biasing devices 74, 76, 78, 80. Each of the spring biasing devices 68, 70, 74, 76, 78, 80 includes a biasing member such as a biasing member 82, provided for example as a coiled spring.

Referring to FIG. 8 and again to FIG. 7, the window unit 12 including the window frame 24 is installed onto the receiving structure 27 of the door assembly. The window unit 12 is installed using multiple fasteners 84 each received in a nut 86 such as a self clinching nut fixed to one of the track channels 26.

Figure 9:
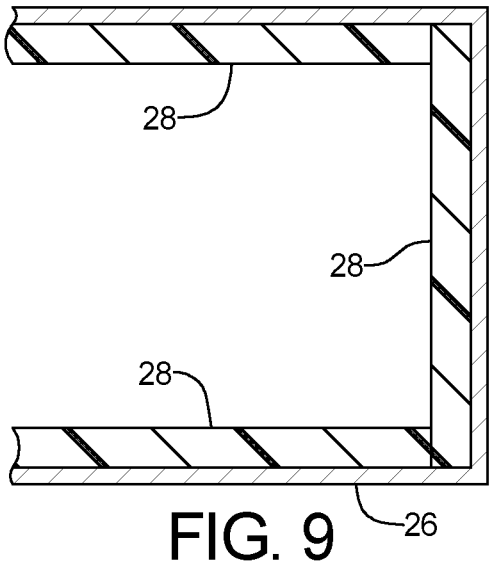
FIG. 9 is a cross sectional top plan view taken at section 9 of FIG. 8.

Referring to FIG. 9, each of the track channels 26 can define a substantially U-shape. The pads 28 are attached to inner perimeter walls of the track channels 26 such that the window frame 24 contacts only the low frictional coefficient material of the pads 28 during sliding travel of the window frame 24.

Figure 10:
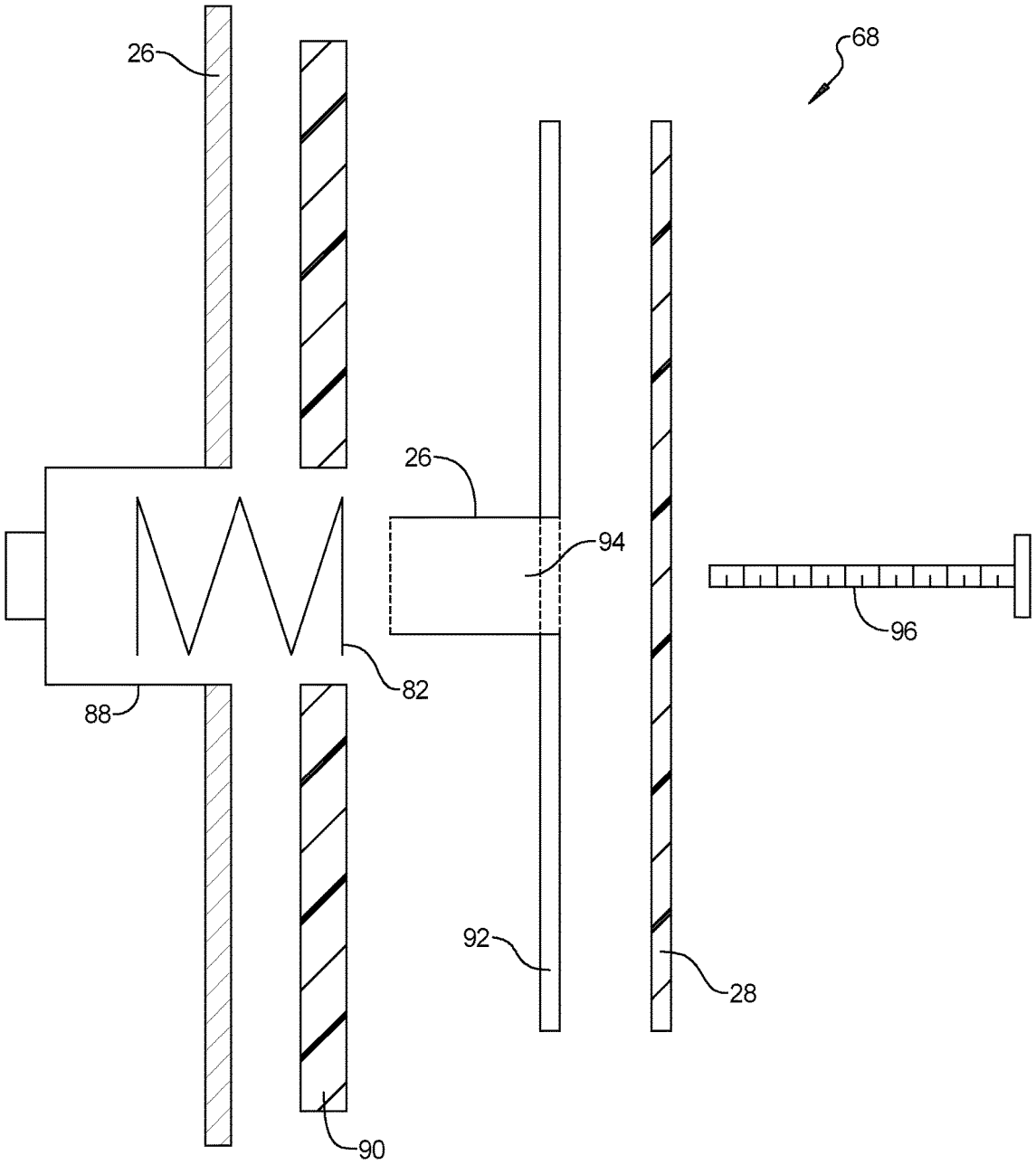
FIG. 10 is an exploded assembly view of an exemplary spring biasing device of the present disclosure.

Referring to FIG. 10, each of the spring biasing devices 68, 70, 74, 76, 78, 80 is installed in substantially the same way, therefore the following discussion of spring biasing device 68 applies equally to each of the other spring biasing devices 70, 74, 76, 78, 80. Spring biasing device 68 includes the multiple biasing members 82, one of which is shown in detail, each individually received and retained within one of multiple spring cup outer members 88 created in the outer wall of the track channel 26. One or more elastic material pads 90 made for example from a rubber material are positioned against the inner facing wall of the track channel 26. A spring steel spring retainer 92 is positioned in direct contact with the one or more elastic material pads 90. The spring retainer 92 includes a male extending spring cup inner member 94 which is received partially within the spring cup outer member 88 and externally receives the biasing member 82 within the spring cup outer member 88. One of the pads 28 is positioned in contact with a window directed face of the spring retainer 92. The spring biasing device 68 assembly is completed by insertion of a fastener 96 such as a bolt extending through the pad 28, the spring cup inner member 94, the elastic material pads 90, a central cavity of the biasing member 82 and through the spring cup outer member 88 to be threadably engaged with a weld nut 98 fixed to the outside facing surface of the spring cup outer member 88. Tension on the fastener 96 can be controlled to change the position of the pad 28 to thereby determine a sliding friction as the window frame 24 displaces.

Figure 8:
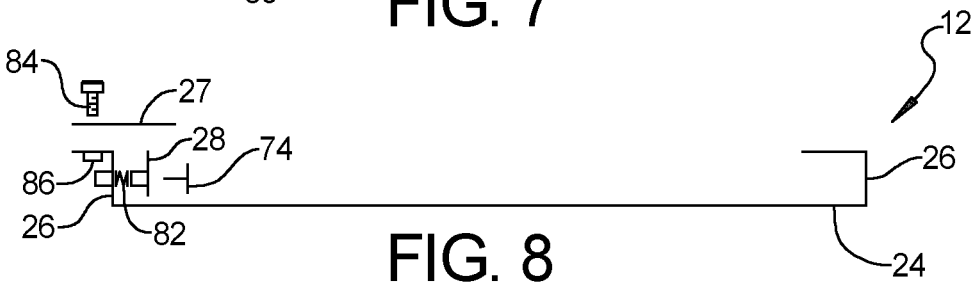
FIG. 8 is a top plan view of the window frame of FIG. 7.
Figure 11:
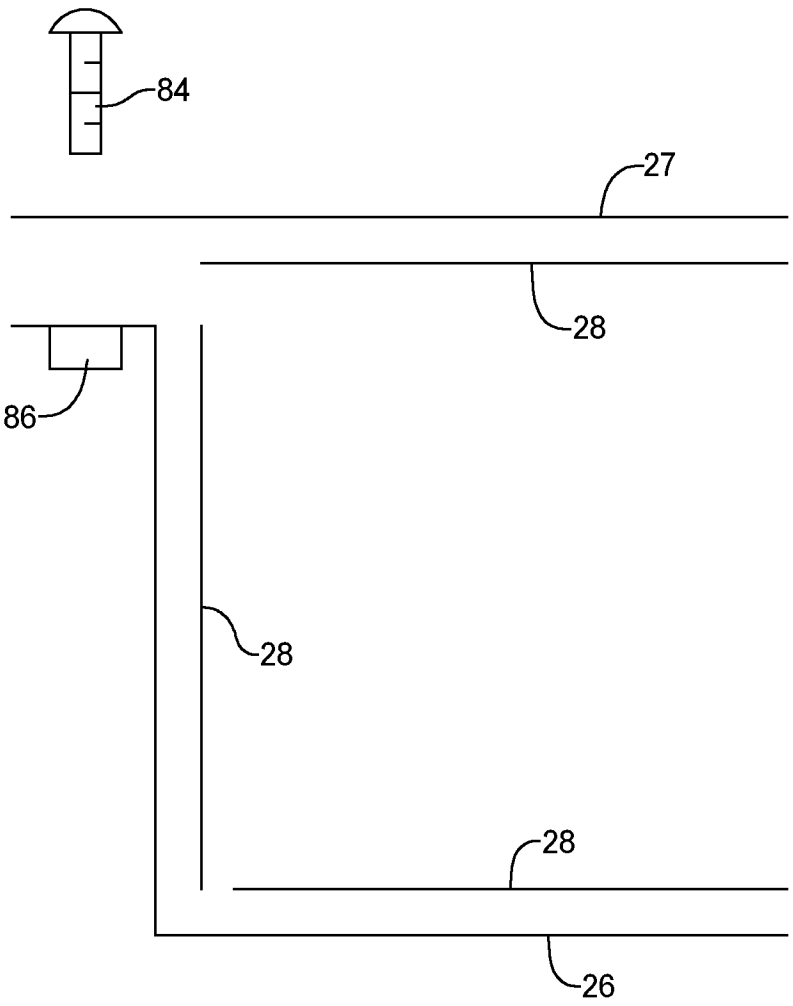
FIG. 11 is an exploded top plan assembly view of a portion of the assembly shown in FIG. 8.

Referring to FIG. 11 and again to FIG. 8, the fasteners 84 are individually received in one of the nuts 86 to connect each of the track channels 26 to the receiving structure 27. This also helps define a U-shape for the pads 28 for directing the window frame 24 sliding motion.

Figure 12:
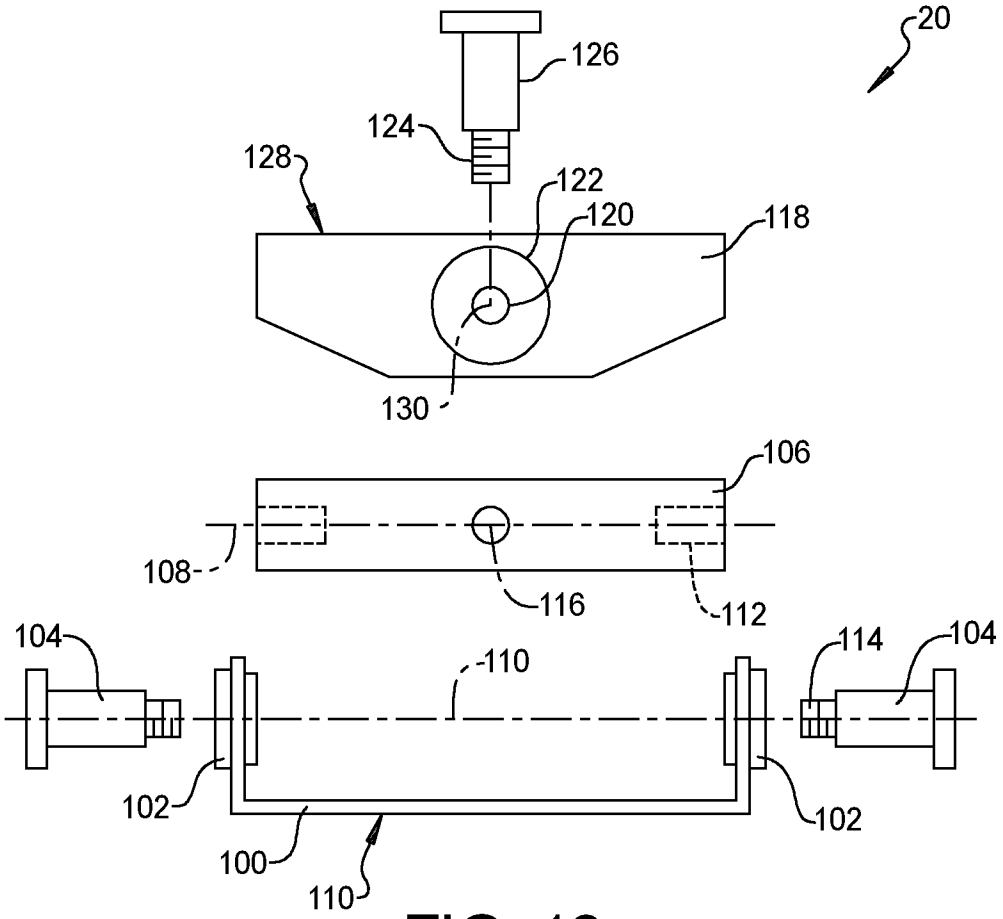
FIG. 12 is a front elevational exploded assembly view of a mechanism connector of the present disclosure.

Referring to FIG. 12 and again to FIGS. 1-3, each of the two mechanism connectors 20 are identical, therefore the following discussion applies to the mechanism connector used at both locations shown in FIG. 1. The mechanism connector 20 includes a U-shaped body or bracket 100 having a bearing 102 at each end. A fastener 104 such as a shoulder bolt is received through each bearing 102 to threadably engage a coupling plate or rod 106 such that the rod 106 rotates with respect to a longitudinal central axis 108 of the rod when a face 110 of the bracket 100 connected to a member of the window mechanism 16 such as a free end of the second telescoping section 52. A threaded bore 112 is created at opposite ends of the rod 106 which each receive a threaded shank 114 of one of the fasteners 104. A threaded bore 116 is centrally positioned in the rod 106 and extends transverse to the longitudinal central axis 108.

A top bracket 118 includes a clearance bore 120 extending through a bearing 122 which receives a threaded shank 124 of a fastener 126 such as a shoulder bolt. The threaded shank 124 is threaded into the threaded bore 116 of the rod 106 to rotatably connect the top bracket 118 to the rod 106 when a face 128 of the top bracket 118 is connected to the lower face 22 of the window frame 24 which supports the window unit 12. The top bracket 118 rotates about an axis 130 extending through the clearance bore 120 providing a second degree of rotation with respect to the rotation provided by the rod 106 with respect to the bracket 100.

A window system 10 of the present disclosure offers several advantages. These include provision of a drive unit installed in a vehicle door frame that provides vertical motion of a bullet-resistant glass window unit. The track channels 26 each have a pad 28 of a low frictional coefficient material which is biased toward contact with the window frame using one or more spring biasing devices. The geometry of the track channels 26 including the flanges 30, 32 are adapted to allow the window unit to raise or lower vertically, and also to displace inwardly and outwardly as necessary between the raised (closed) and lowered (open) positions. The telescoping design of the window mechanism 16 also includes a mechanism connector 20 adapted to transfer an axial rotational force generated by the window mechanism 16 to generate each of a lifting and a lowering force directly to a lower face 22 of a window frame regardless of the condition or position of the vehicle. The window system 10 is also capable of displacing the window unit downward by at least 75% of a height of the window unit to the window lowered or open position.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An armored window drive mechanism including:

a window unit containing a bullet resistant window positioned within a window frame;

the window frame is slidably received and guided within opposed side rails each having a facing of a low frictional coefficient material, the opposed side rails contained between opposed flanges, the side rails including the flanges having a width proximate to a bottom of the side rails that is greater than a width proximate to a top of the side rails, thereby directing the window unit to displace up and down, and also toward and away from an inside space of the vehicle as the window unit is displaced;

a motorized window mechanism connected to a door structure of a vehicle energized to raise and lower the window unit; and at least one mechanism connector converting an axial rotational force generated by the window mechanism to a lifting and a lowering force acting directly at a lower face of the window frame.

2. The armored window drive mechanism of claim 1, wherein the side rails are biased toward contact with the window frame using one or more spring biasing devices.

3. The armored window drive mechanism of claim 1, wherein the at least one mechanism connector includes a first mechanism connector connected between the window mechanism and the door structure.

4. The armored window drive mechanism of claim 3, wherein the at least one mechanism connector includes a second mechanism connector connected between the window mechanism and the window frame.

5. The armored window drive mechanism of claim 1, wherein the motorized window mechanism includes a telescoping unit having a lower unit, a first telescoping section, and a second telescoping section, and wherein the mechanism connector is attached to a free end of the second telescoping section.

6. The armored window drive mechanism of claim 5, wherein the mechanism connector rotatably connects to a receiving member connected to the lower face of the window frame.

7. The armored window drive mechanism of claim 1, wherein between a closed and an open position of the window unit, the window mechanism is operable to displace the window unit downward by at least 75% of a height of the window unit.

8. An armored window drive mechanism including:

a window unit containing a bullet resistant window positioned within a window frame, the window frame slidably received and guided within opposed track channels, the track channels each having: a width proximate to a bottom of the track channels that is different than a width proximate to a top of the track channels, thereby directing the window unit to displace up and down, and also toward and away from an inside space of the vehicle as the window unit displaces; and a pad of a low frictional coefficient material;

a motorized window mechanism connected to a door structure of a vehicle energized to raise and lower the window unit;

at least one mechanism connector converting an axial rotational force generated by the window mechanism to a lifting and a lowering force acting directly at a lower face of the window frame; and a spring biasing device in contact with each of the pads, each of the pads biased into constant contact with a perimeter frame member of the window unit by a biasing force of the spring biasing device;

wherein between a closed and an open position of the window unit, the window mechanism displaces the window unit downward by at least 75% of a height of the window unit.

9. The armored window drive mechanism of claim 8, wherein the pads are attached to inner perimeter walls of the track channels such that the window frame contacts only the low frictional coefficient material of the pads during sliding travel of the window frame.

10. The armored window drive mechanism of claim 8, wherein each spring biasing device is individually received and retained within one of multiple spring cup outer members created in an outer wall of each of the track channels.

11. The armored window drive mechanism of claim 8, wherein the track channels each include a flange positioned within a door structure.

12. The armored window drive mechanism of claim 11, wherein a lower section of the door structure is oriented at a different angle than an upper section of the door structure creating an angular convergence between the lower section and the upper section.

13. An armored window drive mechanism including:

a window unit containing a bullet resistant window positioned within a window frame of a vehicle, the window frame slidably received and guided within opposed side rails, the side rails having a width proximate to a bottom of the side rails that is different than a width proximate to a top of the side rails, thereby directing the window unit to displace up and down, and also toward and away from an inside space of the vehicle as the window unit displaces;

a pad of a low frictional coefficient material provided with each of the track channels;

a spring biasing device in contact with each of the pads, each of the pads biased into constant contact with a perimeter frame member of the window unit by a biasing force of the spring biasing device;

a motorized window mechanism connected to a door structure of a vehicle energized to raise and lower the window unit; and at least one mechanism connector converting an axial rotational force generated by the window mechanism to a lifting and a lowering force acting directly at a lower face of the window frame, the at least one mechanism connector including a first mechanism connector connected between the window mechanism and the door structure and a second mechanism connector connected between the window mechanism and the window frame;

wherein the window mechanism connected to the mechanism connector will positively retract or raise the window unit with the vehicle in a non-upright position.

14. The armored window drive mechanism of claim 13, further including a spring retainer positioned in direct contact with each of the pads, the spring retainer including a male extending spring cup inner member received partially within a spring cup outer member having the biasing member received within the spring cup outer member.

15. The armored window drive mechanism of claim 14, wherein each of the pads is positioned in contact with a window directed face of the spring retainer, the biasing member having a fastener extending through the pad.

* * * * *